US010352081B2

(12) United States Patent
Hirtsiefer et al.

(10) Patent No.: US 10,352,081 B2
(45) Date of Patent: Jul. 16, 2019

(54) FURNITURE HINGE

(71) Applicant: SAMET KALIP VE MADEN ESYA SAN. VE TIC. A.S., Kirac Esenyurt-Istanbul (TR)

(72) Inventors: Artur Hirtsiefer, Neunkirchen-Seelscheid (DE); Bernd Rödder, Ruppichteroth (DE); Nurettin Güzeltepe, Istanbul (TR)

(73) Assignee: Samet Kalip Ve Maden Esya San. Ve Tic. A.S., Istanbul (TR)

( * ) Notice: Subject to any disclaimer, the term of this patent is extended or adjusted under 35 U.S.C. 154(b) by 128 days.

(21) Appl. No.: 15/512,695

(22) PCT Filed: Sep. 4, 2015

(86) PCT No.: PCT/EP2015/070263
§ 371 (c)(1),
(2) Date: Mar. 20, 2017

(87) PCT Pub. No.: WO2016/045941
PCT Pub. Date: Mar. 31, 2016

(65) Prior Publication Data

US 2017/0247923 A1 Aug. 31, 2017

(30) Foreign Application Priority Data

Sep. 26, 2014 (DE) ..... 10 2014 113 970

(51) Int. Cl.
*E05F 3/20* (2006.01)
*E05D 3/16* (2006.01)
(Continued)

(52) U.S. Cl.
CPC ..... *E05F 3/20* (2013.01); *E05D 3/16* (2013.01); *E05D 15/401* (2013.01);
(Continued)

(58) Field of Classification Search
CPC ..... Y10T 16/5383; Y10T 16/53834; Y10T 16/2771; Y10T 16/304; Y10T 16/299;
(Continued)

(56) References Cited

U.S. PATENT DOCUMENTS 5,904,411 A * 5/1999 Hayakawa ..... E05D 15/582 16/289
7,168,477 B2 * 1/2007 Salice ..... E05D 15/262 160/213
(Continued)

FOREIGN PATENT DOCUMENTS

CN 1030629 A 1/1989
CN 1366123 A 8/2002
(Continued)

OTHER PUBLICATIONS

International Search Report issued in connection with PCT Application No. PCT/Ep2015/070263, dated Nov. 20 2015.
(Continued)

*Primary Examiner* — William L Miller
(74) *Attorney, Agent, or Firm* — Steven M. Shape; Dennemeyer & Associates, LLC

(57) ABSTRACT

The invention relates to a furniture hinge (10) with a hinge arm (20) and a fastening portion (30), wherein the hinge arm (20) and the fastening portion (30) are pivotably connected to one another via a multi-axis articulated connection (40), and wherein a damping element (60), which damps in a deflection direction, for damping the movement of the hinge arm (20) and a spring (76) for adjusting the hinge arm (20) with respect to the fastening portion (30) are provided. It is provided here that the damping element (60) is mounted in such a way that, during a folding movement of the hinge arm (20) from a first end position into a second end position, a maximum or a minimum deflection of the damping element (60) is carried out within an adjusting movement of the
(Continued)

damping element (60) caused by said folding movement. As a result, a furniture hinge which can be produced cost-effectively and which allows damped opening and closing of the hinge arm is provided.

14 Claims, 4 Drawing Sheets

(51) Int. Cl.

| | |
|---|---|
| ***E05D 15/40*** | (2006.01) |
| ***E05F 1/10*** | (2006.01) |
| ***E05F 1/12*** | (2006.01) |
| ***E05F 1/14*** | (2006.01) |
| ***E05F 3/00*** | (2006.01) |

(52) U.S. Cl.
CPC ..... *E05F 1/1066* (2013.01); *E05F 1/1269* (2013.01); *E05F 1/14* (2013.01); *E05F 3/00* (2013.01); *E05Y 2201/212* (2013.01); *E05Y 2600/12* (2013.01); *E05Y 2800/24* (2013.01); *E05Y 2900/20* (2013.01)

(58) Field of Classification Search
CPC ..... Y10T 16/61; Y10T 16/625; E05F 3/20; E05F 3/00; E05F 1/1066; E05F 1/1269; E05F 1/14; E05F 1/1058; E05F 1/1075; E05D 3/16; E05D 15/401; E05D 15/262; E05Y 2201/212; E05Y 2600/12; E05Y 2800/24; E05Y 2900/20
USPC ..... 16/286, 289, 54, 50, 65, 82, 85; 312/319.2
See application file for complete search history.

(56) References Cited

U.S. PATENT DOCUMENTS

| | | | | |
|---|---|---|---|---|
| 7,240,974 | B2 * | 7/2007 | Hirtsiefer | E05D 15/262 312/109 |
| 7,448,703 | B2 * | 11/2008 | Kung | E05D 15/262 162/286 |
| 7,478,891 | B2 * | 1/2009 | Hollenstein | E05F 1/1058 312/319.2 |
| 7,500,287 | B2 * | 3/2009 | Brustle | E05F 1/1075 16/286 |
| 8,894,162 | B2 * | 11/2014 | Kashiwaguma | E05F 1/1058 312/319.2 |
| 8,959,709 | B2 * | 2/2015 | Hasegawa | E05D 3/14 16/50 |
| 9,353,562 | B2 * | 5/2016 | Oshima | E05F 1/14 |
| 9,464,473 | B2 * | 10/2016 | Baldreich | E05F 1/1058 |
| 9,903,145 | B2 * | 2/2018 | Huber | E05F 1/1058 |
| 2006/0284530 | A1 * | 12/2006 | Hollenstein | E05F 1/1058 312/327 |
| 2008/0121490 | A1 * | 5/2008 | Dubach | E05F 1/1058 192/17 D |

FOREIGN PATENT DOCUMENTS

| | | | |
|---|---|---|---|
| CN | 1918352 | A | 2/2007 |
| CN | 103109029 | | 5/2013 |
| EP | 1713996 | B1 | 10/2006 |
| EP | 2093361 | A2 | 8/2009 |
| FR | 2708964 | A1 | 2/1995 |
| WO | 2005075778 | | 8/2005 |

OTHER PUBLICATIONS

Chinese Office Action issued in connection with application No. 201580051401.2 dated Nov. 21, 2018.

* cited by examiner

FURNITURE HINGE

The invention relates to a furniture hinge having a hinge part and a fastening portion, wherein the hinge part and the fastening portion are pivotably interconnected by way of a multi-axes articulation connection, and wherein a damper element that damps in a deflection direction for damping the movement of the hinge part, and a spring for readjusting the hinge part in relation to the fastening portion are provided.

Such a furniture hinge is known from EP 1 713 996 B1. Herein, an actuator-arm drive for flaps of cupboards is described, the former having a hinge part that is configured as an actuator arm and that is fastened to a housing so as to be rotatable about an axle. The actuator arm by way of a second axle is connected to a control part that is mounted in a linear and rotatable manner, said control part on that side thereof that is opposite the control arm by way of a control curve bearing on a movable pressure part that is biased by a spring assembly. The linear mobility of the control part is achieved by the mounting on a slide, or by means of an axle that is guided in an elongate hole. The spring force is transmitted to the control arm by way of the control part in such a manner so as to support the opening and closing process of the flap.

The control-arm drive comprises a damper which damps the tilting motion of the control arm ahead of two terminal positions, not influencing said tilting motion therebetween. To this end, the control arm has a detent which during closing of the flap presses against a first end of the damper. During opening of the flap, either the slide or the pressure part presses against the second end of the damper. The damper is preferably embodied as a linear damper.

It is disadvantageous herein that the damper has to be activated from both sides and thus has to be accordingly accessible and readjustable. Furthermore, the damper acts unilaterally on the slide or on the pressure part. In order to avoid jamming of the slide or of the pressure part, said slide and the pressure part therefore have to be guided at correspondingly tight tolerances. Both requirements lead to a high effort in terms of construction and manufacturing.

It is an object of the invention to achieve a reliably operating furniture hinge that is producible in a cost-effective manner and that enables damping of a hinge arm while being outwardly and inwardly folded.

The object of the invention is achieved in that the damper element is mounted in such a manner that during a folding motion of the hinge arm from a first terminal position to a second terminal position, maximum or minimum deflection of the damper element is performed within a readjustment motion of the damper element that is caused by said folding motion. Herein, the maximum and minimum deflection corresponds to the maximum and minimum deflection that is performed within the readjustment motion of the damper element, and do not correspond to the maximum or minimum deflection possible that is defined by the construction of the damper element. However, the maximum and minimum deflections possible, and the maximum and minimum deflections performed, respectively, may be identical, given a corresponding construction of the furniture hinge.

By reversing the movement direction of the readjustment motion at the point of maximum or minimum deflection it is achieved that the hinge arm is damped in that readjustment motion of the damper element that follows the maximum or minimum deflection, respectively. The arrangement herein is chosen in such a manner that the damper element acts in a damping manner in that readjustment direction of the readjustment motion that follows the maximum or minimum deflection, while said damper element does not damp in that readjustment direction that precedes the maximum or minimum deflection. Whether or not maximum or minimum deflection is performed depends on the chosen construction and on the damping direction of the damper element used. If and when a construction in which maximum deflection is performed is chosen, damping is performed during the deflection of the damper element being decreased. By contrast, If and when a construction in which minimum deflection is performed is present, damping is performed during the deflection of the damper element being increased.

Thus, a furniture hinge that in particular is also producible in a cost-effective manner is achieved, which by way of a single damper element that acts in one direction enables damping of a hinge arm both during outward as well as inward folding, ahead of the respective terminal position being reached. Prior to the maximum or minimum deflection of the damper element being reached, respectively, no damping takes place in the case of a corresponding layout, such that the first motion range during opening or closing, respectively, a cupboard door that is fastened by way of the furniture hinge is performed in an undamped manner, for example.

It is provided that the deflection of the damper element in the first terminal position of the hinge arm deviates from the deflection in the second terminal position of the hinge arm; in this way various damping paths may be adjusted for inward and outward folding of the hinge arm and thus for closing and opening a cupboard door that is fastened to the hinge arm. Advantageously, more intense damping, using a longer damping path, may be provided for closing the cupboard door than for opening the cupboard door, for example.

According to a particularly preferred variant of design embodiment of the invention it may be provided that the damper element is mounted to as to be pivotably about a first rotation axis. Herein, a bearing of the damper element is pivoted about the first rotation axis in such a manner that an upper or lower dead center is passed during the readjustment of the damper element. Maximum or minimum deflection of the damper element is achieved during passing of the upper or lower dead center. After the upper or lower dead center has been passed, a reversal of the readjustment direction of the readjustment motion of the damper element is performed. From this point in time onward, the damper element acts in a damping manner. The reversal of the readjustment direction of the damper element is performed during each passage through the upper or lower dead center, respectively, independently of the rotation direction of the pivoting motion. It may thus be achieved that the damper element that damps only in one readjustment direction damps the movement of the hinge arm both during inward folding as well as during outward folding. The furniture hinge is conceived in such a manner that only either the upper or the lower dead center is passed during the hinge arm moving between the two terminal positions. If and when the upper dead center is passed, a damper element is preferably provided which acts in a damping manner when being collapsed. However, if and when a lower dead center is passed, the damper element advantageously acts in a damping manner when being extended. It is achieved in this manner that the movement of the hinge arm is damped prior to one of the terminal positions being reached.

On account thereof, the damper element may be operatively connected to the articulation connection and thus to the hinge arm such that an articulation element of the articulation connection forms the first rotation axis, and that the articulation element is readjustable about a first rotation axis that is formed by a first articulation. Thus, the movement of an articulation element, advantageously provided anyway, of the multi-axes articulation connection that is provided between the hinge arm and the fastening portion may be used for achieving the pivoting motion of the damper element about the first rotation axis. Depending on the construction present, it may however also be necessary for the articulation connection to be augmented by a separate articulation element in order for the damper element to be linked in a corresponding manner to the motion sequence.

A simple construction in which an upper or lower dead center is passed when readjusting the damper element may be achieved in that the damper element is mounted in the region of two support bearings, and in that during readjustment of the furniture hinge from the first terminal position to the second terminal position, a connection line that runs through the support bearings, or the extension of said connection line, crosses the first rotation axis. The upper or lower dead center, respectively, and thus the maximum or minimum deflection, respectively, of the damper element is achieved once the connection line or the extension thereof crosses the first rotation axis. Herein, an upper dead center is passed when the connection line per se crosses the rotation axis, while a lower dead center is passed when the extension of the connection line crosses the rotation axis. It is advantageous in the case of the motion sequence thus achieved that the linear readjustment of the damper element is performed by a converted pivoting motion. Herein, the readjustment direction of the damper element is always aligned in the direction of the input of force by way of the pivoted support bearing of the damper element. Transverse forces are largely avoided such that a flowing movement in which jamming of moved components is reliably avoided without any additional measures being required is achieved.

In order to achieve the pivoting motion and by way thereof the readjustment of the damper element, it is advantageous for a first support bearing of the damper element to be pivoted about the first rotation axis, and for a second support bearing to be kept at a fixed spacing from the first rotation axis. To this end, it may be provided that the damper element is connected to the articulation element, on the one hand, and is connected to a movable lever that is pivotably connected to the latter, on the other hand. The movable lever herein is advantageously connected to the articulation element so as to be pivotable about the first rotation axis about which the damper element is also pivoted. By mounting the second support bearing on the movable lever, the spacing between the second support bearing and the first rotation axis thus remains equal. This also applies when the first rotation axis per se is displaced. On account thereof, it is enabled that the pivoting motion of the damper element about the first rotation axis is achieved in that the latter per se is rotated about a further rotation axis, for example about the first articulation that has been described above. A multiplicity of constructive possibilities in which the damper element may be attached within the multi-axes articulation connection of the furniture hinge is achieved by using a movable lever of this type for attaching the second support bearing of the damper element.

The spring is provided in order to enable self-acting inward and/or outward folding of the hinge arm after activation of the latter. In order for the spring to be coupled to the hinge arm in such a manner that the former adjusts the latter both during inward folding as well as during outward folding, it may be provided that the movable lever is connected to the articulation connection, and is connected to both a connection lever as well as to a spring tensioner in such a manner that the spring that is held between the connection lever and the spring tensioner is tensionable or relaxable during readjustment between the two terminal positions.

In order to enable a readjustment of the hinge arm by the spring in the case of cupboard doors of dissimilar weight that are fitted to the hinge arm and it may be provided that the spring is connected to a tensioning element, and that the spring bias of the spring is adjustable by means of the tensioning element. In this way, a heavier spring bias may be set in the case of heavy cupboard doors than in the case of lighter cupboard doors. Furthermore, the speed of the self-acting opening and closing motion of the cupboard door may be influenced by the spring bias.

According to a variant of embodiment of the invention it may be provided that the movable lever is connected indirectly or directly to the spring that, depending on the position of the hinge arm, is variously intensely deflected in such a manner that a variable compression force, depending on the position of the hinge arm, is transmitted to the articulation element by way of the movable lever. The spring force herein is transmitted from the connection lever and the spring tensioner to the movable lever. The tensile force of the spring herein is converted to a compression force that acts on the movable lever and thus on the articulation connection. This compression force is transmitted to the articulation element in such a manner that the former causes a rotating motion of the articulation element about the first articulation. A cupboard that is fastened to the hinge arm therefore has first to be opened or closed counter to the spring force, prior to said cupboard door in a second movement portion, driven by the spring, completing the opening or closing motion, respectively, in a self-acting and damped manner. By way of the arrangement of the connection lever, of the spring tensioner, of the movable lever, and in particular of the articulation element that is connected to the movable lever and of the rotation axis of said articulation element about the first articulation, it may be achieved that the spring during outward folding of the hinge arm is predominantly relaxed, and during inward folding is predominantly tensioned. Thus, opening of a cupboard door, which may optionally be performed counter to the weight of the cupboard door, is more intensely supported by the spring that closing of the cupboard door, the spring in the case of the latter being relaxed and thus acting in the movement direction of the hinge arm only in the last movement portion.

Apart from adapting the spring force to the fitted cupboard door, it is desirable that damping may also be adapted to the conditions present. This may be achieved in that an adjustment device by way of which the damping stroke and/or the damping force of the damper element is adjustable prior to the first and/or the second terminal position being reached is provided. Damping may thus be adjusted in such a manner that a cupboard door may be closed rapidly, but nevertheless in the last movement portion thereof bears slowly and quietly on a cupboard unit, for example.

In order for damping to be adjustable it may be provided that the damper element is indirectly or directly coupled to the multi-axes articulation connection by way of a guide element, and in that the guide element for adjusting the damping stroke of the damper element is adjustable by means of an adjustment element of the adjustment device on a guide. The position at which the damper element is pivoted about the first rotation axis is established by the guide and the guide element. The chosen position determines the path that the guide element and thus the movable support bearing of the damper element, during being pivoted, performs about the first rotation axis. On account thereof, the readjustment motion of the damper element and the damping stroke are defined. The position, in which the guide element is pivoted about the first rotation axis, and thus the damping stroke, are established by the adjustment element.

Simple adjustment of the damping stroke may be achieved in that a maximum movement of the guide element is adjustable by way of a movable detent at a variable end of the guide. Herein, for example, the guide element bears on the variable end of the guide only in the case of one movement direction of the hinge arm, for example during inward folding. The adjustment of the detent on account thereof only modifies damping during inward folding of the hinge arm in the case of a cupboard door that is fitted to the hinge arm being closed.

Fixedly defined and non-adjustable damping during opening of a cupboard door is sufficient for most application cases. In order to minimize the adjustment effort during fitting of the furniture hinge, it may thus be provided that the guide element during outward folding of the hinge arm, after passing the maximum or the minimum deflection of the damper element, bears on one end of the guide. Damping during opening of the cupboard door is fixedly defined if and when this end is not variably adjustable. A furniture hinge which during inward folding of the hinge arm has adjustable damping, and during outward folding has fixedly defined damping may thus be provided.

Simple coupling of the damper element to the articulation connection of the furniture hinge may be achieved in that the guide is disposed on the articulation element.

Herein, the adjustment of the damping stroke may be performed in that the detent is formed by an eccentric that is rotatably mounted on the articulation element and that, depending on the rotation thereof, keeps the guide element at a variable spacing from the rotation axis thereof.

In one potential variant of design embodiment of the invention it is provided that the first terminal position of the hinge arm is assigned to an inwardly folded hinge arm, and the second terminal position is assigned to an outwardly folded hinge arm, and that the readjustment of the damper element between the minimum or the maximum deflection and the deflection in the first terminal position of the hinge arm is larger than the readjustment of the damper element between the minimum or the maximum deflection and the deflection in the second terminal position of the hinge arm. On account thereof, a larger damping stroke is present during inward folding of the hinge arm and thus during closing of a connected cupboard door than during outward folding of the hinge arm during opening of the cupboard door.

Advantageously and cost-effectively, a linear damper is provided as the damper element.

The invention will be explained in more detail hereunder by means of an exemplary embodiment which is illustrated in the drawings. In the drawings.

Figure 1:
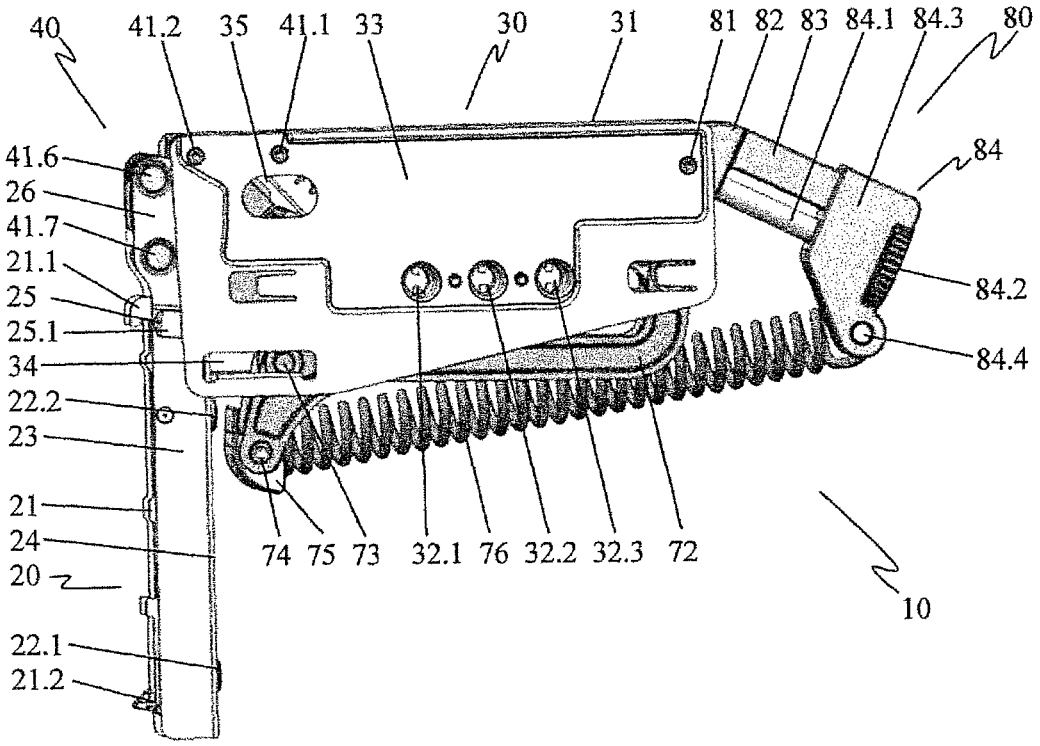
FIG. 1 shows a furniture hinge in first terminal position of an inwardly folded hinge arm, in the case of a closed hinge housing, in a side view.

FIG. 1 shows a furniture hinge 10 in a first terminal position of an inwardly folded hinge arm 20, in the case of a closed hinge housing 31, in a side view;

The hinge housing 31 forms a fastening portion 30 of the furniture hinge 10, having three fastening receptacles 32.1, 32.2, 32.3. The hinge housing 31 in the illustration is closed off by a housing lid 33. A linear guide 34 and an adjustment opening 35 are provided as passage openings in the housing lid 33. Fastening points of a first articulation 41.1, of a second articulation 41.2, and of a rotary joint 81 are sunk into the housing lid 33.

The hinge arm 20 is pivotably connected to the fastening portion 30 by way of a multi-axes articulation connection 40. A first and a second set screw 22.1, 22.2 are disposed along a rear web 24 of the hinge arm 20. Lateral legs 23 adjoin the rear web 24 on either side. The hinge arm 20 engages in a connection element 21 which has connection hooks 21.1, 21.2. Toward the articulation, the lateral legs 23 transition to an articulation guide 26 by way of an expansion region 25 that is reinforced by an embossing 25.1. A sixth articulation 41.6 and a seventh articulation 41.7 of the multi-axes articulation connection 40 are disposed on the articulation guide 26.

The multi-axes articulation connection 40 is connected to the fastening portion 30 by way of the first and the second articulation 41.1, 41.2, and is connected to the hinge arm by way of the sixth and seventh articulation 41.6, 41.7.

A spring tensioner 80 is attached to the fastening portion 30 by way of the rotary joint 81, so as to be opposite the articulation connection 40. The spring tensioner 80 is assigned a tensioning element 84 that is composed of a knurled screw 84.1 having a knurled head 84.2 and a slide 84.3 having a spring eyelet 84.4 attached thereto. The slide 84.3 is mounted so as to be displaceable on a slider bar 83. The slider bar 83 and the knurled screw 84.1 at the end side are fixed to a common base 82 which establishes the connection to the fastening portion 30 of the furniture hinge 10.

A spring 76 is hooked to the spring eyelet 84.4, the former by way of the opposite end thereof being fastened to a spring holder 75. The spring holder 75 at the end side is connected to an approximately S-shaped connection lever 72 by way of a pin 74. The connection lever 72 by way of a guide pin 73 is guided in the linear guide 34 that is attached to the housing lid 33.

In the fitted state, the hinge arm 20 is assigned to a cupboard door or to a flap, and the fastening portion 30 is assigned to a base unit of an item of furniture (not illustrated). Herein, the connection element 21 by way of the connection hooks 21.1, 21.2 engages in a connection piece (not illustrated) which is fastened to the cupboard door or to the flap. The cupboard door or the flap may be aligned in relation to the base unit by way of the set screws 22.1, 22.2. The fastening portion 30 by means of fastening means (not illustrated) which are routed through the fastening receptacles 32.1, 32.2, 32.3, is fastened to the base unit.

Figure 6:
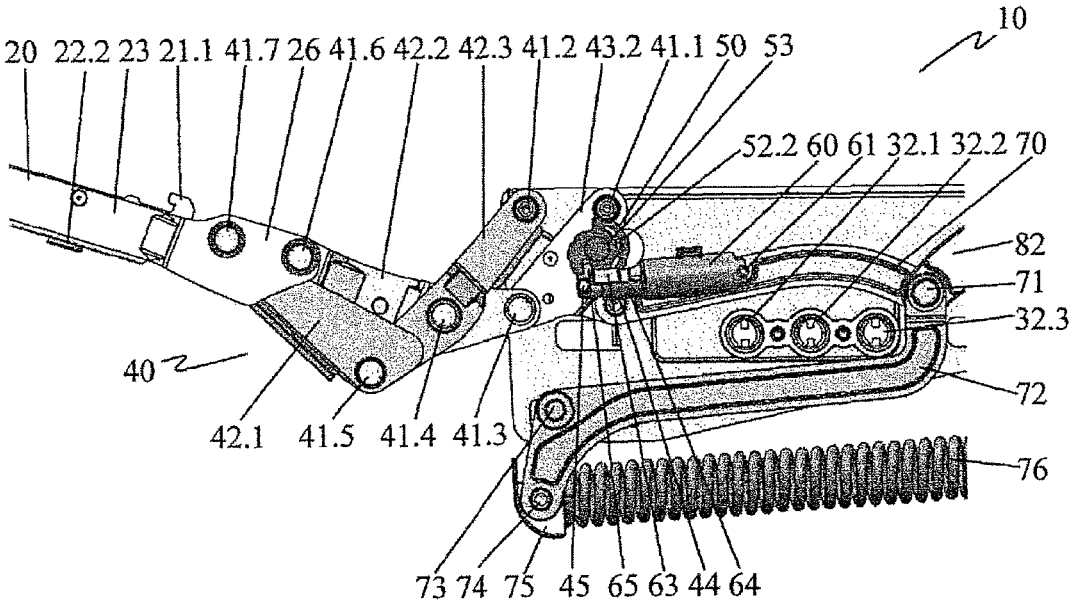
FIG. 6 shows the furniture hinge of FIG. 2 in a second terminal position, in the case of an outwardly folded hinge arm.

The hinge arm 20, during opening of the cupboard door or of the flap, is pivoted from the closed first terminal position shown to an opened second terminal position shown in FIG. 6. The spring 76 herein, from a specific position of the hinge arm 20, causes the cupboard door or the flap to open in a self-acting manner. Accordingly, the spring 76, during closing of the cupboard door or of the flap, pulls the hinge arm 20 on the last movement portion thereof back to the first terminal position of the latter. The bias of the spring 76 may be adapted to the respectively fitted cupboard door or flap by way of the spring tensioner 80, such that cupboard doors or flaps of variable weights and dimensions may be opened or closed as has been described. To this end, the slide 84.3 of the tensioning element 84, by rotating the knurled screw 84.1 at the knurled head 84.2 thereof, is adjusted along the slider bar 83 until the desired bias of the spring 76 that is connected to the slide is provided.

Figure 2:
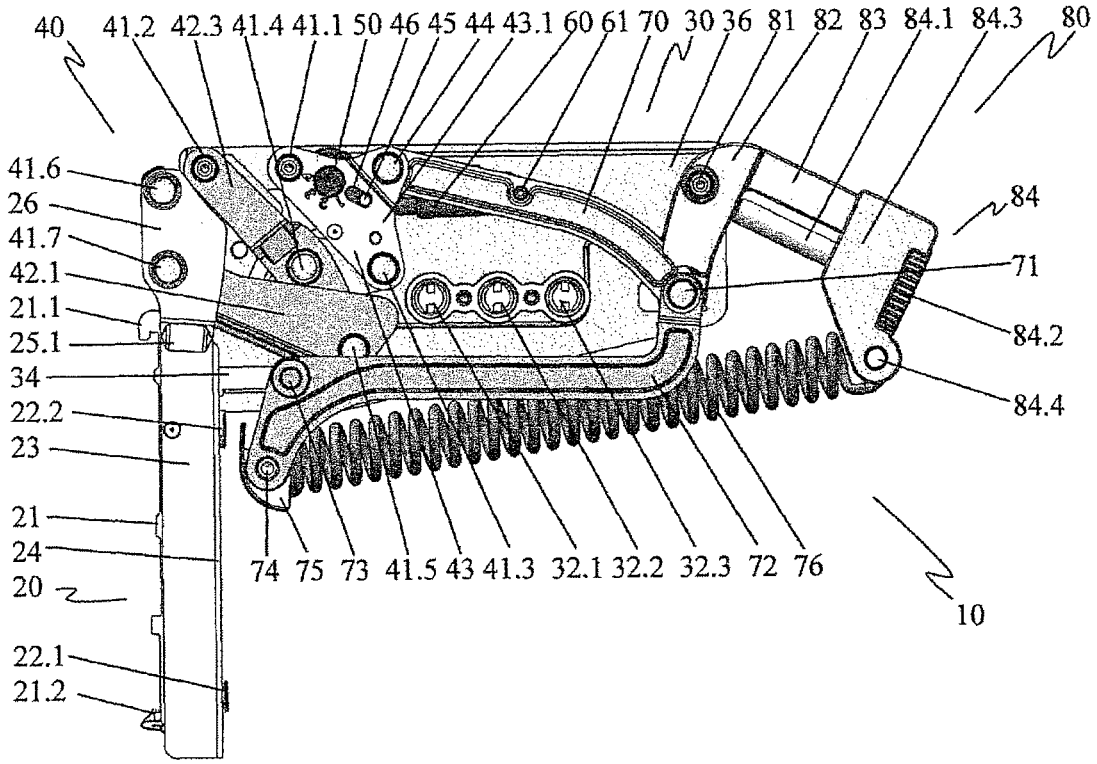
FIG. 2 shows the furniture hinge of FIG. 1, in the case of an opened hinge housing.

FIG. 2 shows the furniture hinge 10 of FIG. 1, in the case of an opened hinge housing 31. Identical components herein are referenced as has been introduced in FIG. 1.

The hinge housing 31 at the rear side is closed off by way of a rear housing wall 36 which has the same passages, articulation receptacles, and fastening receptacles 32.1, 32.2, 32.3 as the housing lid 33 that is shown in FIG. 1. Components of the furniture hinge 10 may thus be held or routed between the housing lid 33 and the rear housing wall 36. The furniture hinge 10 may be fitted to a cupboard base unit both on the right as well as the left side, wherein either the rear housing wall 36 or the housing lid 33 bears on the cupboard wall.

Figure 3:
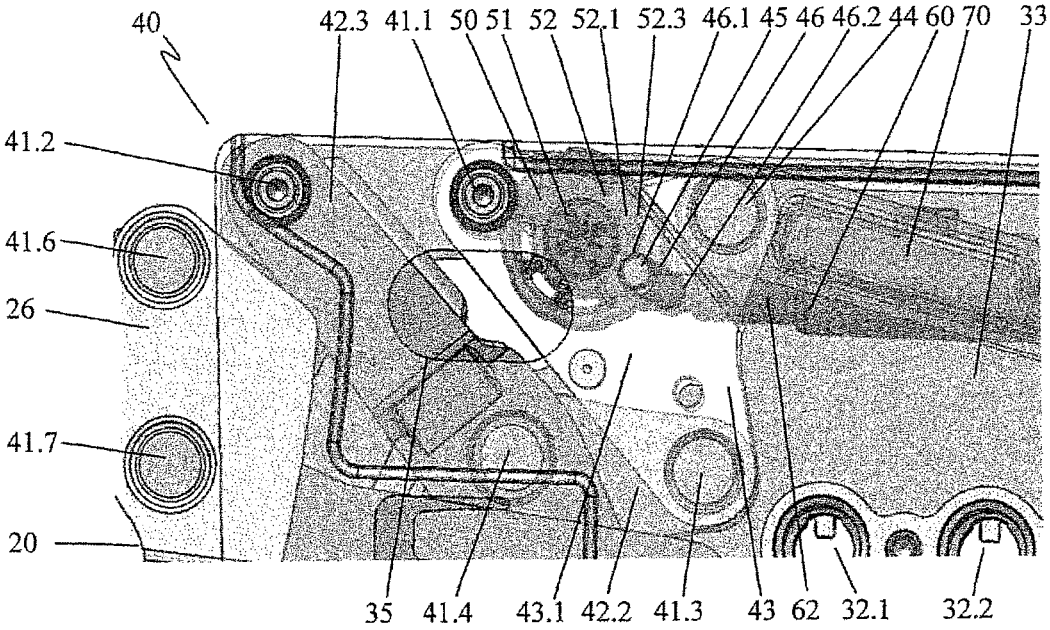
FIG. 3 shows a fragment of the furniture hinge of FIG. 2, in the region of an articulation element.
Figure 4:
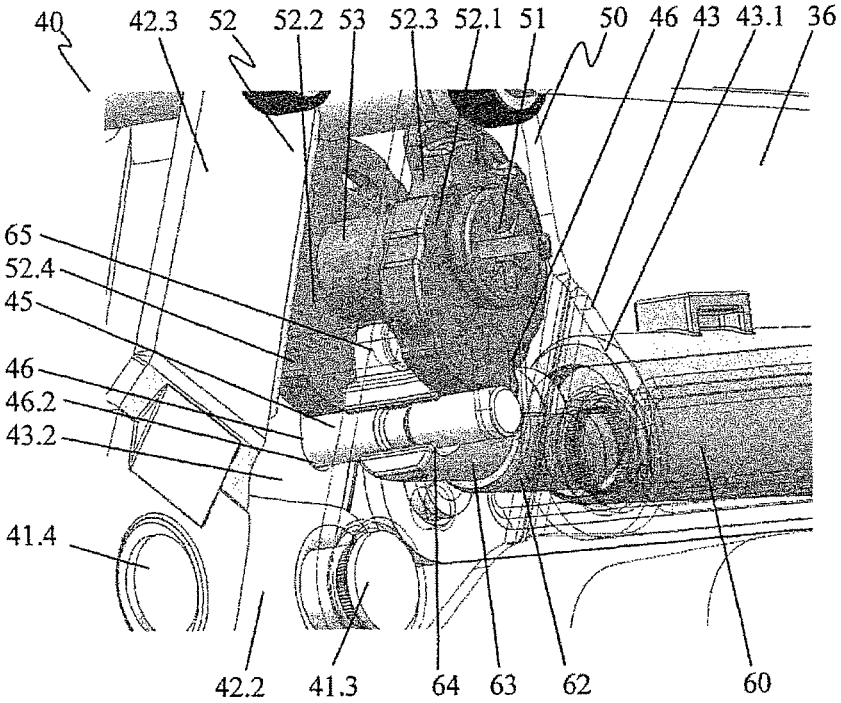
FIG. 4 shows the fragment of the furniture hinge of FIG. 3, in a perspective illustration, in the case of a partially outwardly folded hinge arm.

A first articulation lever 42.1 of the multiple-axes articulation connection 40 is disposed between the seventh articulation 41.7 on the articulation guide 26 of the hinge arm 20, and a fifth articulation 41.5 that is displaceable in the position thereof. A second articulation lever 42.2 that is shown in FIGS. 3, 4, and 6 is accordingly disposed between the sixth articulation 41.6 on the articulation guide 26 of the hinge arm 20, and a third articulation 41.3 that is likewise displaceable in the position thereof. A third articulation lever 42.3 is rotatably fastened to the hinge housing 31 by means of the second articulation 41.2. The third articulation lever 42.3 in the central region thereof by way of a fourth articulation 41.4 is likewise rotatably connected in an approximately centric manner to the second articulation lever 42.2.

An approximately triangular articulation element 43 at one corner is rotatably connected to the hinge housing 31 by way of the first articulation 41.1. The articulation element 43 at an opposite corner is rotatably connected to the second articulation lever 42.2 by way of the third articulation 41.3. A first rotation axle 44 in the form of a further articulation axle is disposed on a third corner of the articulation element 43 that faces away from the multiple-axle articulation connection 40. The articulation element 43 herein is rotatably connected to one end of a bent movable lever 70.

Figure 5:
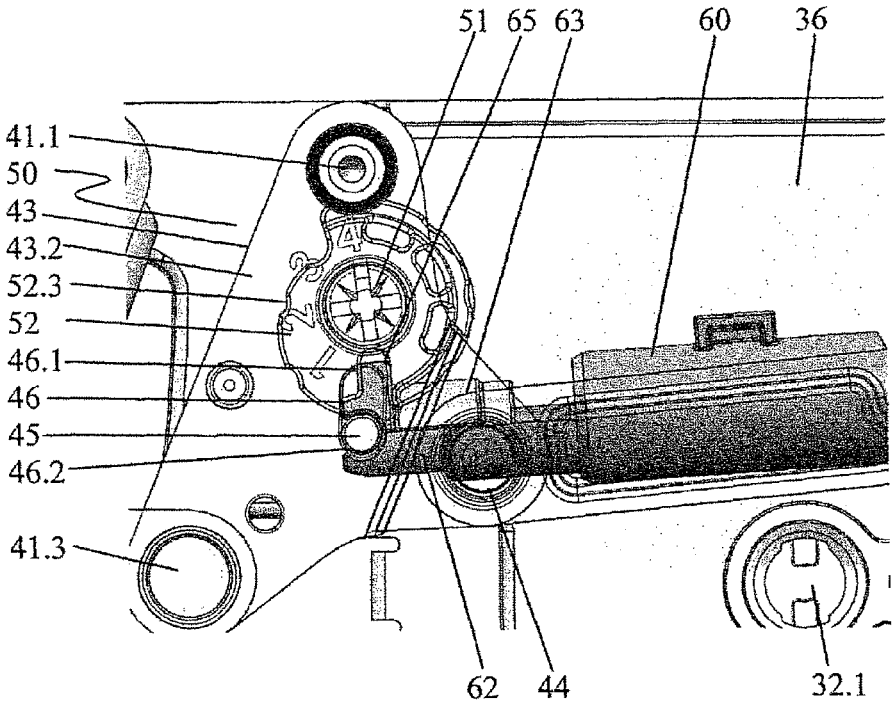
FIG. 5 shows the fragment of the furniture hinge of FIG. 4, in a side view.

The articulation element 43 is formed from two mutually opposite articulation plates 43.1, 43.2 that are disposed so as to be spaced apart, wherein the forward first articulation plate 43.1 can be seen in the illustration chosen in FIG. 2. The rearward second articulation plate 43.2 that is shown in FIGS. 4, 5, and 6, is obscured by the first articulation plate 43.1. A guide 46 in the form of elongate holes, each aligned in the direction toward the first articulation 41.1, is provided in the central region of the articulation plates 43.1. An adjustment element 50 is disposed between the guide 46 and the first articulation 41.1.

A damper element 60, damping in a linear manner, by way of a guide element 45 is mounted so as to be rotatable and displaceable in the elongate holes of the guide 46. The damper element 60, at the opposite end thereof, by way of a counter bearing 61 is rotatably fastened to the movable lever 70.

The movable lever 70, the base 82 of the spring tensioner 80, and the connection lever 72 each are interconnected at the end side by way of an articulation axle 71.

The multiple-axle articulation connection 40, by way of the seven articulations 41.1, 41.2, 41.3, 41.4, 41.5, 41.6, 41.7 thereof, configures a known seven-way articulation connection between the hinge arm 40 and the fastening portion 30. During outward folding of the hinge arm 20 to an opened second terminal position that is shown in FIG. 6, the third articulation lever 42.3 is rotated about the second articulation 41.2, and the articulation element 43, by way of the first and the second articulation plate 43.1, 43.2 thereof, is rotated about the first articulation 41.1. On account thereof, the first rotation axis 44 in the illustration chosen is pivoted about the first articulation 41.1 in the clockwise direction. The first rotation axle 44 herein crosses the connection line between the guide element 45 and the counter bearing 61, and thus between the support bearings of the damper element 60. Herein, proceeding from the first terminal position illustrated, the spacing between the guide element 45 and the counter bearing 61 is enlarged until the guide element 45, the first rotation axle 44, and the counter bearing 61 are in line. If and when the articulation element 43 is rotated farther beyond this point about the first articulation 41.1, the spacing between the guide element 45 and the counter bearing 61 is again decreased. The motion sequence is performed in the reversed order during folding back of the hinge arm 20. The damper element 60 during a folding motion of the hinge arm 20 between the two terminal positions, during intersecting of the connection line of the support bearings of the damper element 60 by the first rotation axle 44, thus passes a maximum deflection within the readjustment motion. The deflection of the damper element 60 is again decreased during continuation of the rotating motion.

The damper element 60 used acts in a damping manner only in one readjustment direction, during collapsing of the damper element 60. No damping of the movement of the articulation element 43 and of the hinge arm 20 is thus performed in the motion sequence described, until the maximum deflection of the damper element 60 is achieved. After the maximum deflection, the damper element 60 by contrast acts in a damping manner on the movement of the articulation element 43 and thus, transmitted by the multi-axle articulation connection 40, on the movement of the hinge arm 20. Since the readjustment direction of the damper element 60 is reversed both during inward folding as well as during outward folding of the hinge arm 20, damping of the movement of latter is in each case performed prior to achieving one of the terminal positions of the hinge arm 20. On account thereof, both damped opening as well as damped closing of a cupboard door or flap that is fastened to the hinge arm 20 is achieved by way of only one damper element that damps in a linear manner in one direction.

By way of the spring 72 that is tensioned between the spring tensioner 80 and the connection lever 72, the spring tensioner 80 is rotated about the rotary joint 81, and the connection lever 72 is rotated counter thereto about the guide pin 73. On account thereof, a compression force is transmitted by way of the common articulation axle 71 to the movable lever 70, and from the latter on the first rotation axle 44 to the articulation element 43. In this manner, a torque which in the alignment of the articulation element 43 during the inwardly folded terminal position of the hinge arm 20 shown in FIG. 2 acts in a counter-clockwise manner is transmitted to the articulation element 43. The torque thus counteracts a rotating motion of the articulation element 43 during outward folding of the hinge arm 20. If and when the hinge arm 20 is folded out counter to the action of the spring 76 to the extent that the first rotation axle 44 crosses the connection line between the first articulation 41.1 and the articulation axle 71, the compression force that is transmitted by the movable lever 70 causes a torque in the clockwise direction and thus in the direction of the rotating motion of the articulation element 43 that is caused by the outward folding of the hinge arm 20. From this point in time on, the spring force that is transmitted supports the movement of the hinge arm 20. By way of a corresponding layout of the spring 76 it is achieved that the hinge arm 20, once partially opened, folds outward to the opened terminal position thereof in a self-acting manner. The movement herein is damped by the damper element 60 before the opened terminal position has been reached. Accordingly, the reversed motion sequence is performed during inward folding of the hinge arm. Here too, the spring force initially counteracts the inward folding of the hinge arm 20, prior to said spring force acting in the movement direction of the hinge arm 20 once the first rotation axle 44 has crossed the connection line between the first articulation 41.1 and the articulation axle 71. On account thereof, the last movement portion of the hinge arm 20 during inward folding is performed in a self-acting manner.

The bias of the spring 76 may be adapted by the tensioning element 84 of the spring tensioner 80 in such a manner that a self-acting movement of the hinge arm in the case of cupboard doors or flaps of dissimilar weight that are guided by the hinge arm 20 is enabled. To this end, the position of the slide 84.3 is displaced along the slider bar 83 with the aid of the knurled screw 84.1.

By mounting the damper element 60 by way of the counter bearing 61 thereof on the movable lever 70 it is achieved that the spacing between the counter bearing 61 and the first rotation axle 44 remains the same, independently of the position of the articulation element 43 and of the movable lever 70. The readjustment of the damper element 60, and thus the damping stroke thereof, is thus defined by the position at which the guide element 45 is held on the articulation element 43 and is rotated about the first rotation axle 44, and by the rotation angle between the articulation element 43 and the movable lever 70.

The damping stroke of the damper element during outward and inward folding of the hinge arm 20 may be variably embodied by the position of the guide element 45 on the articulation element 43 and by the pivoting range of the guide element 45 about the first rotation axle 44. In this way, it is provided in the exemplary embodiment shown that during outward folding of the hinge arm 20, from the first terminal position shown in FIG. 2 to the second terminal position shown in FIG. 6, up to reaching the maximum deflection of the damper element 60, initially a comparatively large angular range is passed by the guide element 45 by way of a correspondingly large readjustment of the damper element 60. Following the maximum deflection, a comparatively small angular range is passed by way of a correspondingly smaller readjustment of the damper element 60. The motion sequence is performed in reverse order during inward folding of the hinge arm 20. The damping stroke during outward folding of the hinge arm 20 is thus chosen so as to be smaller than the damping stroke during inward folding of the hinge arm 20.

By contrast, it is provided during the introduction of the spring force that the first rotation axle 44 as the coupling-in point for the spring force into the articulation element 43 during outward folding of the hinge arm 20 crosses the connection line between the first articulation 41.1 and the articulation axle 71 already after a short rotating motion about the first articulation 41.1. The spring force counteracts the movement of the articulation element 43 and thus of the hinge arm 20 only in a first small movement range, so as to subsequently act across a large movement range in the movement direction of the articulation element 43 and thus of the hinge arm 20. Here too, the motion sequence is reversed during inward folding of the hinge arm 20. Thus, the spring 76 acts across a large movement range of the hinge arm 20 in the direction of an opening position of a cupboard door or a flap that is fastened to the hinge arm 20, acting to close the cupboard door or the flap only in the direct proximity of the closing position.

By way of this asymmetrical effect of both the damper element 60 as well as of the spring 76 during outward and inward folding of the hinge arm 20 it is achieved that opening of a cupboard door or a flap, counter to the force of gravity acting thereon, with the support of the spring 76 is performed in a smooth-running manner or, in a last movement portion, in a self-acting manner. The movement herein is dampened just before the end of the opening procedure. By contrast, a significantly longer damping stroke is provided during closing of the cupboard door or the flap, so as to avoid an impact of the cupboard door or the flap on a cupboard base unit. Herein, the cupboard door or the flap, respectively, in the last movement range thereof is pulled into the closing position thereof in a self-acting manner.

The furniture hinge 10 may be adapted to cupboard doors and flaps of dissimilar weight by adjusting the spring bias.

FIG. 3 shows a fragment of the furniture hinge of FIG. 2, in the region of an articulation element 43, in the case of an inwardly folded hinge arm 20. Herein, the housing lid 33 and the first articulation plate 43.1 of the articulation element 43 are illustrated so as to be semi-transparent, in order to allow a view onto the components lying there behind.

The guide element 45 as the support bearing of the damper element 60 is mounted in the guide 46 on the articulation element 43. The guide 46 herein is embodied by elongate holes which are attached so as to be congruent, both in the first articulation plate 43.1 as well as in the second articulation plate 43.2 that is disposed in an obscured manner. The guide 46 thus enables a rotating motion as well as a linear readjustment of the guide element 45 that is mounted in the former. The elongate holes are aligned toward the first articulation 41.1, so as to be spaced apart from the first rotation axle 44. The adjustment element 50 is disposed between the guide 46 and the first articulation 41.1. As is also shown in the context of FIG. 4, the adjustment element 50 is rotatably mounted between the first and the second articulation plate 43.1, 43.2 of the articulation element 43. To this end, a tool engagement feature 51 is introduced in a corresponding through-opening of the first articulation plate 43.1. As is shown in the context of FIG. 4, the adjustment element 50 is furthermore formed by an eccentric 52 having a first and a second eccentric disk 52.1, 52.2. Each eccentric disk 52.1, 52.2 on the circumference is assigned one latching curve 52.3, 52.4. The eccentric disks 52.1, 52.2 are spaced apart by an axle 53.

As can be seen from FIG. 3, the eccentric 52 may be rotated such that the former, by way of the external circumference and latching curves 52.3, 52.4 thereof covers part of the elongate holes of the guide 46. On account thereof, an adjustable variable end 46.1, having the eccentric 52 as a detent for the guide element 45, is achieved on that region of the guide 46 that faces the first articulation 41.1. Opposite thereto, a fixed end 46.2 delimits the guide 46.

When inwardly folding the hinge arm 20 to the closed position illustrated, the guide element 45, is pushed against the variable end 46.1 of the guide by the damper element 60, counteracting the movement. The detent for the guide element 45 may be displaced according to the latching curves 52.3, 52.4 by rotating the adjustment element 50. The position of the guide element 45 in the inwardly folded position of the hinge arm 20 shown, in the effective direction of the damper element 60 is thus defined by the adjustment element 50. The readjustment path of the damper element 60, and thus the damping stroke, during inward folding of the hinge arm 20 may thus be adjusted by the adjustment element 50. Herein, a damping stroke that can be set as small as possible results in the adjustment of the adjustment element 50 shown in FIG. 3, the latter allowing maximum linear movement of the guide element 45 in the guide 46. If and when the adjustment element 50 is rotated in such a manner that the latching curves 52.3, 52.4 protrude at maximum into the elongate holes of the guide 46, such that the guide element 45 is displaced in the direction of the fixed end 46.2 of the guide 46, a maximum damping stroke of the damper element during inward folding of the hinge arm 20 is achieved. The damping stroke may be adjusted between the two extreme positions by way of corresponding intermediate positions of the adjustment element 50. It is achieved by the interaction of the latching curves 52.3, 52.4 and the guide element 45 that the adjustment element 50 can only be adjusted to defined latching positions. This enables a reproducible adjustment of the damping stroke as well as locking of the chosen adjustment.

In the inwardly folded terminal position of the hinge arm 20, shown in FIG. 3, the tool engagement feature 51 of the adjustment element 50 is covered by the housing lid 33. During outward folding of the hinge arm 20, the tool engagement feature 51 pivots into the region of the adjustment opening 35 of the housing lid 33. The adjustment of the damping stroke may then be performed with the cupboard door or the flap opened.

A piston rod 63, shown in FIG. 4, is routed through a cover 62 and is protected by the latter.

FIG. 4 shows the fragment of the furniture hinge 10 of FIG. 3, in a perspective illustration, in the case of a partially opened position of the hinge arm 20. Herein, the first articulation plate 43.1 of the articulation element 43 is illustrated so as to be transparent.

The piston rod 63 of the damper element 60, the former being partially enveloped by the cover 62, at the end thereof has a guide-element receptacle 64 in which the guide element 45 that is embodied as a transverse pin is held. A setting element 65 in the form of an appendage is configured on the guide-element receptacle 64. The setting element 65, in the position of the hinge arm illustrated, is aligned toward the axle 53 of the adjustment element 50 and bears on the latter.

By way of the setting element 65 the guide element 45 is displaced in relation to the fixed end 46.2 of the guide 46, independently of the adjustment of the adjustment element 50. During outward folding of the hinge arm 20, from the closed terminal position thereof to the opened terminal expediently thereof, the guide element 45 is therefore expediently moved from the variable end 46.1 of the guide 46 to the fixed end 46.2 of the latter, and held there. The position of the guide element 45 during opening of the hinge arm 20 is fixedly defined on account thereof. The damping stroke of the damper element 60 during outward folding of the hinge arm 20 is thus also fixedly defined, while the damping stroke during inward folding of the hinge arm 20 can be adjusted by the adjustment element 50.

In the maximum adjustment of the adjustment element 50 illustrated, the guide element 45 is also held by the eccentric 52 on the side of the fixed end 46.2 of the guide 46. A maximum damping stroke is thus adjusted during inward folding of the hinge arm 20 and thus during closing of a cupboard door or a flap that is fastened to the hinge arm 20.

FIG. 5 shows the fragment of the furniture hinge 10 of FIG. 4, in a side view, in the case of a partially outward folded hinge arm 20. The first articulation plate 43.1 is illustrated so as to be partially transparent.

In order for the intermediate position illustrated to be achieved, the guide 46, by way of the guide element 45, during the outward folding of the hinge arm 20, commencing in the closing position shown in FIG. 3, has been pivoted in the clockwise direction about the first articulation 41.1. On account thereof, the setting element 65 has been aligned on the axle 53 of the adjustment element 50, and the guide element 45 has been pressed against the fixed end 46.2 of the guide 46. During the continuing movement in which the guide element 45 is pivoted about the first rotation axle 44 in the clockwise direction, the piston rod 63 of the damper element 60 is inserted into the damper element by the guide element 45, on account of which damping is effected. The damping stroke herein is fixedly defined by the fixed positioning of the guide element 45 on the fixed end 46.2 of the guide 46.

FIG. 6 shows the furniture hinge 10 of FIG. 2 in a second terminal position, in the case of an outwardly folded hinge arm 20. The first articulation plate 43.1 is not shown.

The second articulation plate 43.2 of the articulation element 43 is pivoted about the first articulation 41.1 by outwardly folding the hinge arm 20. By way of the movement of the articulation element 43 the first rotation axle 44 in relation to the position of the latter in FIG. 2 is alternated to the opposite side of the damper element 60, having thereby crossed the connection line between the guide element 45 and the counter bearing 61. On account thereof, the reversal of movement in the readjustment of the damper element 60 as has been described in the context of FIG. 2 is performed.

The setting element 65 is routed past the axle 53 of the adjustment element 50, but still bears thereon in such a manner that the guide element 45 is held on the fixed end 46.2 of the guide 45.

During outward folding of the hinge arm 20 the articulation axle 71 as the connection point between the movable lever 70, the connection lever 72, and the base 82 of the spring tensioner 80, pivots about the rotary joint 81 shown in FIG. 2. The rotation in the present illustration is performed in the clockwise direction. During the folding motion thus generated between the base 82 and the connection lever 72, the spring 76 is relaxed and the released energy by way of the movable lever 70 is transmitted to the multi-axle articulation connection 40 and thus to the pivot arm 20.

The movable lever 70 and the connection lever 72 are disposed and shaped in such a manner that both of former during the movement thereof between the two terminal positions do not cross the positions of the fastening receptacles 52.1, 52.2, 52.3, independently of the adjustment of the spring tensioner 80 or of the adjustment element 50.

Fastening elements may thus be routed through the fastening receptacles 52.1, 52.2, 52.3 without blocking the movement of the hinge arm 20.

Figure 7:
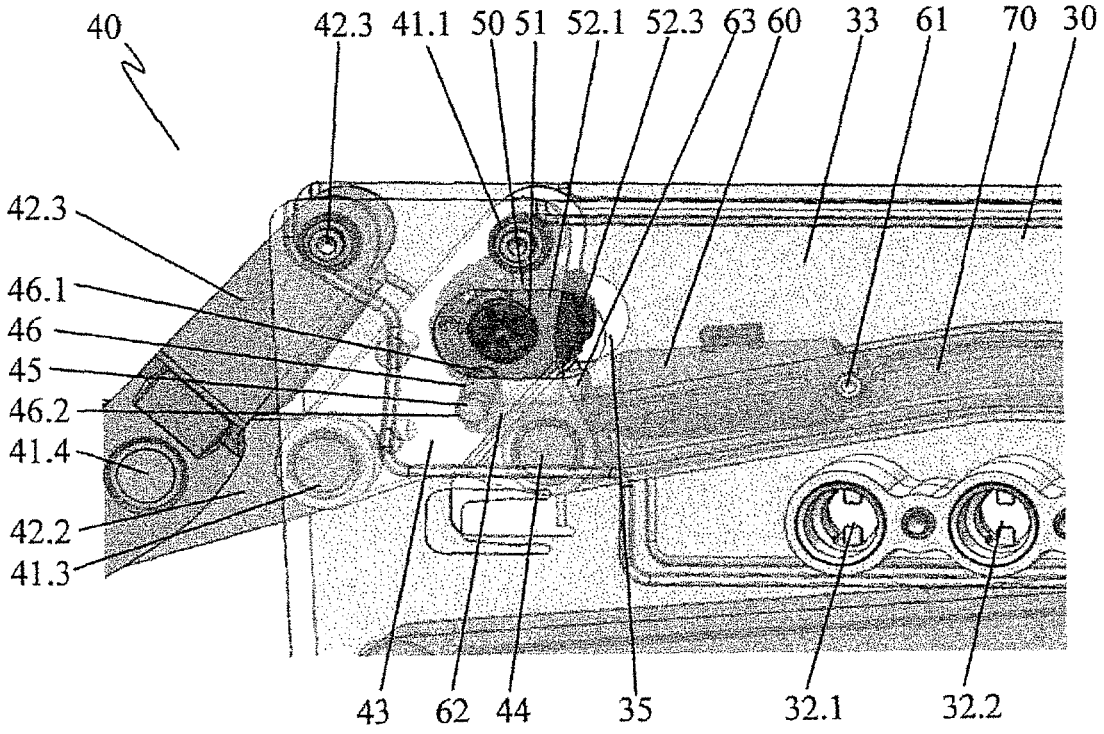
FIG. 7 shows a fragment of the furniture hinge of FIG. 6, in the region of the articulation element.

FIG. 7 shows a fragment of the furniture hinge 10 according to FIG. 6, in the region of the articulation element 63. The first articulation plate 63.1 of the articulation element 63, and the housing lid 33 are illustrated so as to be semi-transparent.

The position of the articulation element 63 in the case of a hinge arm 20 that is outwardly pivoted to the second terminal position thereof is shown. In this position, the tool engagement feature 51 of the adjustment element 50 is positioned so as to be opposite the adjustment opening 35 in the housing lid 33, the former thus being accessible from the outside.

The guide element 45 is held at the fixed end 46.2 of the guide 46, on account of which the deflection of the damper element 60 is established in this position of the articulation element 63 and thus of the hinge arm 20.

The invention claimed is:

1. A furniture hinge (10) having a hinge arm (20) and a fastening portion (30), wherein the hinge arm (20) and the fastening portion (30) are pivotably inter-connected through an articulation connection (40) including an articulation element (43), and wherein a damper element (60) is connected to the articulation element (43), and to a movable lever (70) which is pivotably connected to the articulation element (43) and mounted so as to be pivotable about a first rotation axis (44), and wherein the damper element (60) damps in a deflection direction for damping the movement of the hinge arm (20), the articulation element (43) forms the first rotation axis (44), and the articulation element (43) is re-adjustable about a second rotation axis that is formed by a first articulation (41.1), and a spring (76) is included for readjusting the hinge arm in relation to the fastening portion (30)

characterized in that the damper element (60) is mounted in such a manner that during a folding motion of the hinge arm (20) from a first terminal position to a second terminal position, maximum or minimum deflection of the damper element (60) is performed within a readjustment motion of the damper element that is caused by said folding motion.

2. The furniture hinge (10) as claimed in claim 1, wherein the deflection of the damper element (60) in the first terminal position of the hinge arm (20) deviates from the deflection in the second terminal position of the hinge arm (20).

3. The furniture hinge (10) as claimed in claim 1, wherein the damper element (60) is mounted in the region of two support bearings, and in that, during readjustment of the furniture hinge (10) from the first terminal position to the second terminal position, a connection line that runs through the support bearings, or the extension of said connection line, crosses the first rotation axis (44).

4. The furniture hinge (10) as claimed in claim 1, wherein the movable lever (70) is connected to the articulation connection (40), and is connected to both a connection lever (72) as well as to a spring tensioner (80) in such a manner that the spring (76) that is held between the connection lever (72) and the spring tensioner (80) is tensionable or relaxable during readjustment between the two terminal positions.

5. The furniture hinge (10) as claimed claim 1, wherein the spring (76) is connected to a tensioning element (84), and in that the spring bias of the spring (76) is adjustable by means of the tensioning element (84).

6. The furniture hinge (10) as claimed in claim 1, wherein the movable lever (70) is connected indirectly or directly to the spring (76) that, depending on the position of the hinge arm (20), is variously intensely deflected in such a manner that a variable compression force, depending on the position of the hinge arm (20), is transmitted to the articulation element (43) by way of the movable lever (70).

7. The furniture hinge (10) as claimed in claim 1, wherein an adjustment device by way of which the damping stroke and/or the damping force of the damper element (60) is adjustable prior to the first and/or the second terminal position being reached is provided.

8. The furniture hinge (10) as claimed in claim 1, wherein the damper element (60) is indirectly or directly coupled to the articulation connection (40) by way of a guide element (45), and in that the guide element (45) for adjusting the damping stroke of the damper element (60) is adjustable by means of an adjustment element (50) of the adjustment device on a guide (46).

9. The furniture hinge (10) as claimed in claim 1, wherein a maximum movement of the guide element (45) is adjustable by way of a movable detent at a variable end (46.1) of the guide (46).

10. The furniture hinge (10) as claimed in claim 8, wherein the guide element (45) during outward folding of the hinge arm (20), after passing the maximum or the minimum deflection of the damper element (60), bears on one end (46.1, 46.2) of the guide (46).

11. The furniture hinge (10) as claimed in claim 8, wherein the guide (46) is disposed on the articulation element (20).

12. The furniture hinge (10) as claimed in claim 9, wherein the detent is formed by an eccentric (52) that is rotatably mounted on the articulation element (20) and that, depending on the rotation thereof, keeps the guide element (46) at a variable spacing from the rotation axis thereof.

13. The furniture hinge (10) as claimed in claim 1, wherein the first terminal position of the hinge arm (20) is assigned to an inwardly folded hinge arm (20), and the second terminal position is assigned to an outwardly folded hinge arm (20), and in that the readjustment of the damper element (60) between the minimum or the maximum deflection and the deflection in the first terminal position of the hinge arm (20) is larger than the readjustment of the damper element (60) between the minimum or the maximum de-flection and the deflection in the second terminal position of the hinge arm (20).

14. The furniture hinge (10) as claimed in claim 13, wherein a linear damper is provided as the damper element (60).

* * * * *